US005713523A

United States Patent [19]

Fujikawa

[11] Patent Number: 5,713,523

[45] Date of Patent: Feb. 3, 1998

[54] ELECTROMAGNETIC FUEL INJECTION VALVE, AND METHOD FOR ASSEMBLING NOZZLE ASSEMBLY

[75] Inventor: Takuya Fujikawa, Saitama, Japan

[73] Assignee: Zexel Corporation, Japan

[21] Appl. No.: 577,929

[22] Filed: Dec. 22, 1995

[30] Foreign Application Priority Data

Dec. 28, 1994 [JP] Japan ..... 6-337635

[51] Int. Cl.[6] ..... B05B 1/30

[52] U.S. Cl. ..... 239/585.1; 239/585.5; 251/129.16

[58] Field of Search ..... 239/585.1, 585.3, 239/585.4, 585.5, 533.1, 533.2, 533.3, 533.6, 533.9; 251/129.15, 129.16, 129.21; 123/305, 472; 29/890.124, 890.126, 890.129

[56] References Cited

U.S. PATENT DOCUMENTS

| | | | |
|---|---|---|---|
| 4,199,850 | 4/1980 | Velan | 29/157.1 R |
| 5,178,362 | 1/1993 | Vogt et al. | 251/129.21 |
| 5,188,336 | 2/1993 | Graner et al. | 251/129.16 |
| 5,197,672 | 3/1993 | Grytz et al. | 239/1 |
| 5,236,173 | 8/1993 | Wakeman | 251/129.16 |
| 5,244,180 | 9/1993 | Wakeman et al. | 251/129.16 |
| 5,330,153 | 7/1994 | Reiter | 251/129.21 |
| 5,383,606 | 1/1995 | Stegmaier et al. | 239/575 |
| 5,428,883 | 7/1995 | Stieglitz | 29/602.1 |
| 5,566,920 | 10/1996 | Romann et al. | 239/585.4 |
| 5,580,001 | 12/1996 | Romann et al. | 239/585.4 |

FOREIGN PATENT DOCUMENTS

| | | |
|---|---|---|
| 5-504181 | 7/1993 | Japan . |
| 5-504182 | 7/1993 | Japan . |

*Primary Examiner*—Andres Kashnikow
*Assistant Examiner*—Lisa Ann Douglas
*Attorney, Agent, or Firm*—Ostrolenk, Faber, Gerb & Soffen, LLP

[57] ABSTRACT

An electromagnetic fuel injection valve is provided, which allows the amount of lift to be adjusted and established following the assembly of the nozzle assembly so that it is suitable for high pressure cylinder injection of fuel and which also allows the amount of lift to be established with high precision. A method for assembling the nozzle assembly is also offered.

This invention comprises a thin-walled skirt portion formed in a protruding manner at the nozzle holder, a valve seat that is introduced under pressure to the skirt portion, with the valve seat and the nozzle holder welded and joined at the skirt portion, and, preferably, the application of a load from the outside of the nozzle holder following welding to bring about the irreversible deformation of the nozzle holder and establish the final amount of lift.

18 Claims, 6 Drawing Sheets

*FIG. 1*
*PRIOR ART*

*FIG. 2*
*PRIOR ART*

ELECTROMAGNETIC FUEL INJECTION VALVE, AND METHOD FOR ASSEMBLING NOZZLE ASSEMBLY

BACKGROUND OF THE INVENTION

1. Field of the Invention

The present invention relates to an electromagnetic fuel injection valve and to a method for assembling the nozzle assembly, and more particularly to an electromagnetic fuel injection valve that allows the amount of lift in a needle valve to be established with high precision in electromagnetic fuel injection valves used for high pressure fuel injection such as cylinder injection of gasoline, as well as to a method for assembling the nozzle assembly.

2. Description of the Related Art

In the conventional establishment of the amount of lift in needle valves for electromagnetic fuel injection valves employed in cylinder injection of gasoline, electromagnetic fuel injection valves have a configuration that is designed to establish the amount of needle valve lift by having the armature come into direct contact with the lift stopper in response to magnetization of the electromagnetic coil. Examples include Japanese Patent Nos. Hei.5-504181 and Hei.5-504182.

FIG. 5 is a vertical cross section illustrating an example of a conventional electromagnetic fuel injection valve 1. This electromagnetic fuel injection valve 1 comprises a connector 2, a valve housing 3, a nozzle holder 4, a fuel supply pipe 5 consisting of a magnetic substance, a spring seat 6, a valve seat 7, and an electromagnetic coil 8 that is magnetized and demagnetized by means of control signals from the connector 2.

An armature 9 in the form of a tube and a needle valve 10 that is integrally movable with this armature 9 are provided downwardly in the figure and are opposite the fuel supply pipe 5.

An injection hole 12 is formed in a steel plate 11 located at the tip of the valve seat 7, and the needle valve 10 is always energized in the direction of this injection hole 12 by the valve spring 13 so as to be seated in the seat portion 7A of the valve seat 7.

A lift amount adjusting shim 14 is provided on the upstream side of the valve seat 7, and the steel plate 11 is held between the valve seat 7 and a holding plate 15 on the downstream side.

Fuel such as gasoline is fed from the upper part (in the figure) of the fuel supply pipe 5 to the first fuel channel 16, from the first fuel channel 16 through the second fuel channel 17 inside the armature 9, through the third fuel channel 18 between the nozzle holder 4 and the armature 9 or needle valve 10, through the fourth fuel channel 19 inside the lift amount adjusting shim 14, and to the fifth fuel channel 20 between the valve seat 7 and the needle valve 10.

The interval between the fuel supply pipe 5 and the armature 9 is used as the amount of lift L for the needle valve 10. As a result of the magnetization of the electromagnetic coil 8, the armature 9 and the needle valve 10 are integrally lifted against the urging force of the valve spring 13, and the fuel is sprayed from the injection hole 12 into the engine cylinder 21.

With the demagnetization of the electromagnetic coil 8, the armature 9 and the needle valve 10 are returned to their original positions by the urging force of the valve spring 13, and the injection hole 12 is closed off.

The amount of lift L for the needle valve 10 is established in the following manner.

That is, the lift amount adjusting shim 14, valve seat 7, steel plate 11, and holding plate 15 are inserted in that order from the downstream side of the tubular tip 4A of the nozzle holder 4, and the leading end portion of the tubular tip 4A is crimped to form a crimped portion 22, thereby fixing these parts.

If a thicker lift amount adjusting shim 14 is inserted, the valve seat 7 is located further downstream, allowing a greater amount of lift L to be established, whereas the insertion of a thinner lift amount adjusting shim 14 allows a smaller amount of lift L to be established.

The dimensions of the valve housing 3, needle valve 10, and the like are thus determined, a lift amount adjusting shim 14 is selected for use to allow the prescribed amount of lift L to be obtained, and the leading end portion of the tubular tip portion 4A is crimped, so that the lift amount adjusting shim 14, valve seat 7, steel plate 11, and holding plate 15 are fixed to the tubular tip portion 4A.

The amount of lift L in such an electromagnetic fuel injection valve 1, however, usually requires extremely high dimensional precision of, say, 50±5 μm. In the conventional electromagnetic fuel injection valve 1 described above, a large number of parts are connected with the amount of lift L, and since the crimped part 22 is formed after the selection of the lift amount adjusting shim 14 used to determine the final amount of lift L, there is a possibility that the very act of crimping results in the deformation of the various parts in the tubular tip portion 4A, with many problems arising in accurately establishing the amount of lift L.

During the manufacturing process, moreover, the problem of loose parts in the tubular tip portion 4A makes it difficult to avoid the problems in precision described above because the portion is invariably crimped firmly, so that the amount of lift L cannot be adjusted after the crimping.

FIG. 6 is a vertical cross section illustrating an example of another conventional electromagnetic fuel injection valve 30. The same parts are indicated by the same symbols, and their description is thus omitted. Only the different parts are described. In this electromagnetic fuel injection valve 30, a ball valve 10A which allows a fuel channel to be formed, with the surface 5 cut flat, is attached to the tip of the needle valve 10, and the ball valve 10A is seated in the seat portion 7A of the valve seat 7.

A steel plate 31 in the form of a cross-sectional arc, in which a steel plate 11 has been bent on the upstream side, is used, the resilience resulting from its tension is utilized in bringing it under pressure into the tubular tip portion 4A, and two prescribed locations in the peripheral portion adjacent to the tubular tip 4A and in the central portion adjacent to the valve seat 7 (peripheral weld location 32 and central weld location 33) are fixed by electronic seal welding such as laser welding.

The seal welding is done, however, after the steel plate 31 as been fixed in a location greater than the prescribed amount of lift L (for example, greater than 50 μm).

A probe M for measuring the amount of lift L is then attached to the upstream side of the armature 9, and the steel plate 31 is pushed in, with the probe set up in a state allowing the amount of lift L to be measured, as a prescribed load is applied from the downstream side to the upstream side. The amount of lift L is gradually reduced, and when the prescribed amount of lift L has been obtained, the plate is no longer pushed in, so as to conclude the establishment of the amount of lift L.

That is, the load is applied on the steel plate 31 from the downstream side to the upstream side, and as the amount of lift L is measured, the steel plate 31 is reversibly deformed in establishing and adjusting the prescribed amount of lift L.

In this method for assembling the nozzle assembly (ball valve 10 A, needle valve 10, and valve seat 7), the amount of lift L can be adjusted as it is directly measured, so the precision of the amount of lift L is greater than in the case of the electromagnetic fuel injection valve 1 shown in FIG. 5.

Since, however, the steel plate 31 has a thin plate thickness of 0.2 to 0.25 mm, it can be used for low pressure fuel injection valves with a fuel pressure of about 3 kg/cm$^2$, but it cannot be used for high pressure cylinder injection of fuel in fuel injection valves for cylinder injection of gasoline, where the fuel pressure is extremely high at 40 to 100 kg/cm$^2$. The high fuel pressure would cause the steel plate 31 to fly off in the direction of the engine cylinder 21.

When the plate thickness of the steel plate 31 is increased to make it resistant to such high pressure, greater welding energy is needed to join the parts, and the resulting heat leads to the problems of poor roundness in the seat portion 7A of the valve seat 7 and poor oil-tightness.

Problems in conventional electromagnetic fuel injection valves 1 and 30 and the like are that they are difficult to make resistant to high pressure fuel injection such as in cylinder injection of gasoline and that the amount of lift is difficult to adjust and establish with good precision.

SUMMARY OF THE INVENTION

With the foregoing in view, it is an object of the present invention to provide an electromagnetic fuel injection valve that is suitable for high pressure cylinder injection of fuel and that allows the amount of lift to be established with high precision, as well as a method for assembling the nozzle assembly.

It is another object of the present invention to provide an electromagnetic fuel injection valve that allows the amount of lift to be adjusted and established after assembly of the nozzle assembly, as well as a method for assembling the nozzle assembly.

It is yet another object of the present invention to provide an electromagnetic fuel injection valve in which the valve seat does not fly off in the direction of the engine cylinder in the unlikely event of defective welding, as well as a method for assembling the nozzle assembly.

That is, the present invention is the outcome of attention to the fact that a thin-walled skirt portion is formed at the nozzle holder, with the valve seat introduced therein under pressure, the fact that the skirt portion and valve seat are welded, and the fact that the amount of lift is preferably finally established following the welding by applying a load from the outside to the nozzle holder to irreversibly deform the nozzle holder or valve seat. The first invention is an electromagnetic fuel injection valve comprising a valve housing, an electromagnetic coil located in the valve housing, an armature responding to the magnetization of the electromagnetic coil, a valve seat in which a fuel injection hole for fuel has been formed, a nozzle holder for fixing the valve seat, and a needle valve allowing fuel to be sprayed from the injection hole when the valve seat is lifted from the seat portion along with the armature in response to the magnetization of the electromagnetic coil, wherein a thin-walled skirt portion is formed in a protruding manner at the nozzle holder, the valve seat is introduced under pressure to the skirt portion, and the valve seat and nozzle holder are welded and joined at the skirt portion.

A protruding step portion can also be formed along the outer peripheral surface of the valve seat, and a stopper portion that can be engaged with the protruding step portion can be formed along the inner circumferential surface of the nozzle holder.

The second invention is a method for assembling the nozzle assembly of an electromagnetic fuel injection valve having a valve housing, an electromagnetic coil located in the valve housing, an armature responding to the magnetization of the electromagnetic coil, a valve seat in which a fuel injection hole for fuel has been formed, and a needle valve allowing fuel to be sprayed from the injection hole when the valve seat is lifted from the seat portion along with the armature in response to the magnetization of the electromagnetic coil, and a nozzle holder for fixing the valve seat by combining the needle valve and the valve seat in the form of a nozzle assembly, comprising a pressurized introduction step in which the valve seat is introduced under pressure to the thin-walled skirt portion formed in a protruding manner at the nozzle holder, and a welding step in which the valve seat and the nozzle holder are integrated by being welded and joined at the skirt portion.

A lift amount adjusting step can also be included, wherein a load is applied to the outer peripheral portion while the nozzle assembly is fixed, so as to adjust the amount of lift for the needle valve.

In the electromagnetic fuel injection valve and the method for assembling the nozzle assembly in the present invention, a thin-walled skirt is formed at the nozzle holder, the valve seat is introduced under pressure to the skirt portion, and the nozzle holder and the valve seat are then welded at the skirt portion, so the valve seat is introduced under pressure by estimating the contraction of the nozzle holder and the valve seat caused by the welding. The amount of lift can thereby be established. The crimped portion formed after the amount of lift has been established as in the case of the conventional electromagnetic fuel injection valve 1 (FIG. 5) is not needed thus allowing problems of deviation in the amount of lift from the established value to be avoided.

The precision of the amount of lift can be enhanced when the amount of lift is finally established by applying a load from the outside of the nozzle holder to irreversibly deform the nozzle holder after the nozzle holder and the valve seat have been welded.

A thin-walled skirt portion can also be formed at the tip of the nozzle holder, and the parts can be welded and joined at the skirt portion, so that, unlike the conventional electromagnetic fuel injection valve 30 (FIG. 6), no steel plate 31 is used, allowing the device to be adapted for high pressure fuel injection and allowing the thermal effects on the valve seat to be greatly reduced.

When a stopper portion that can be engaged with the protruding step portion formed along the outer peripheral surface of the valve seat is formed along the inner circumferential surface of the nozzle holder, the valve seat can be prevented from separating from the nozzle holder and flying off in the direction of the engine cylinder in the unlikely event of a defective welding.

DESCRIPTION OF THE PREFERRED EMBODIMENTS

Figure 5:
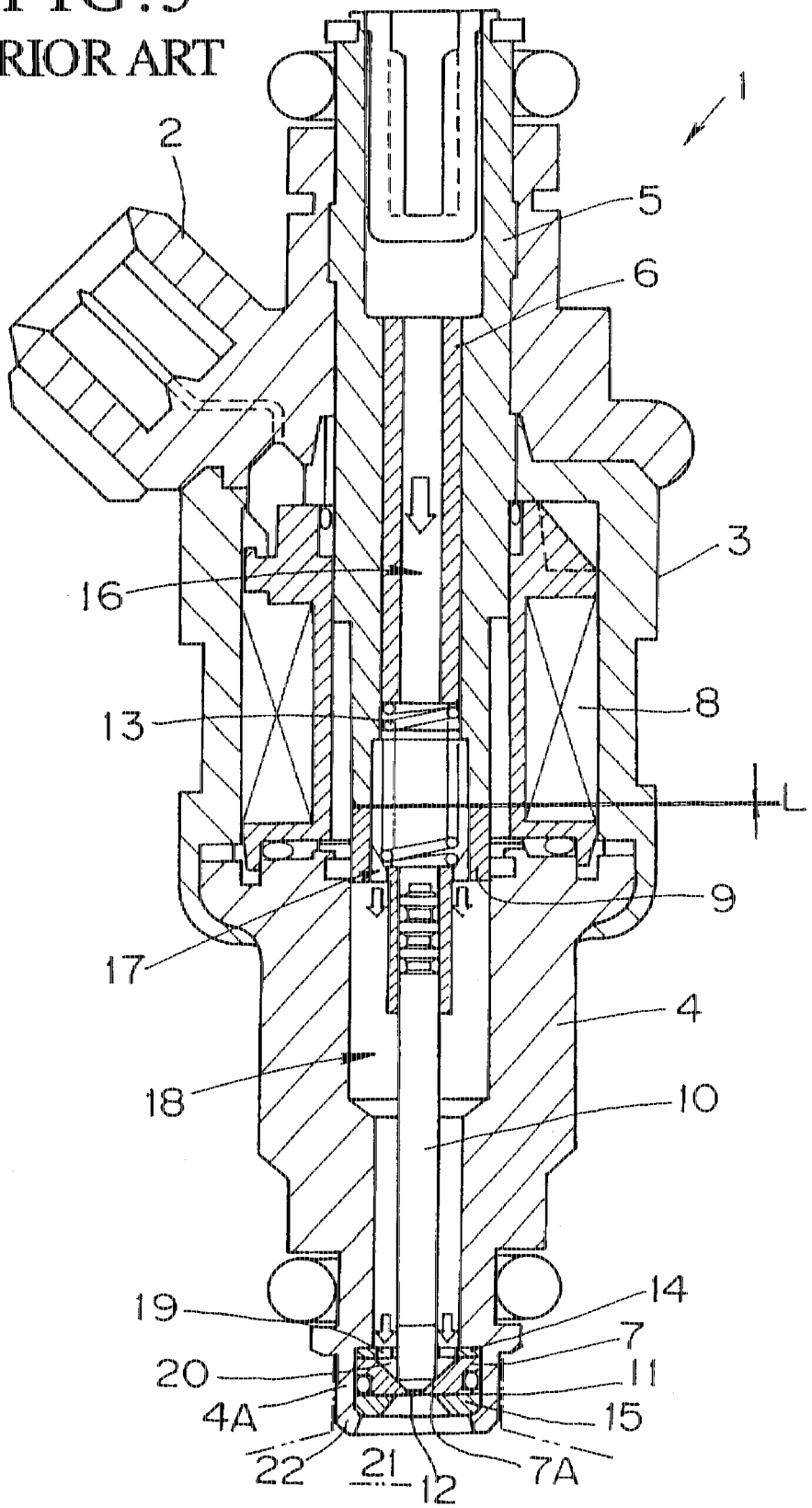
FIG. 5 PRIOR ART
FIG. 5 is a vertical cross section illustrating an example of a conventional electromagnetic fuel injection valve 1.
Figure 6:
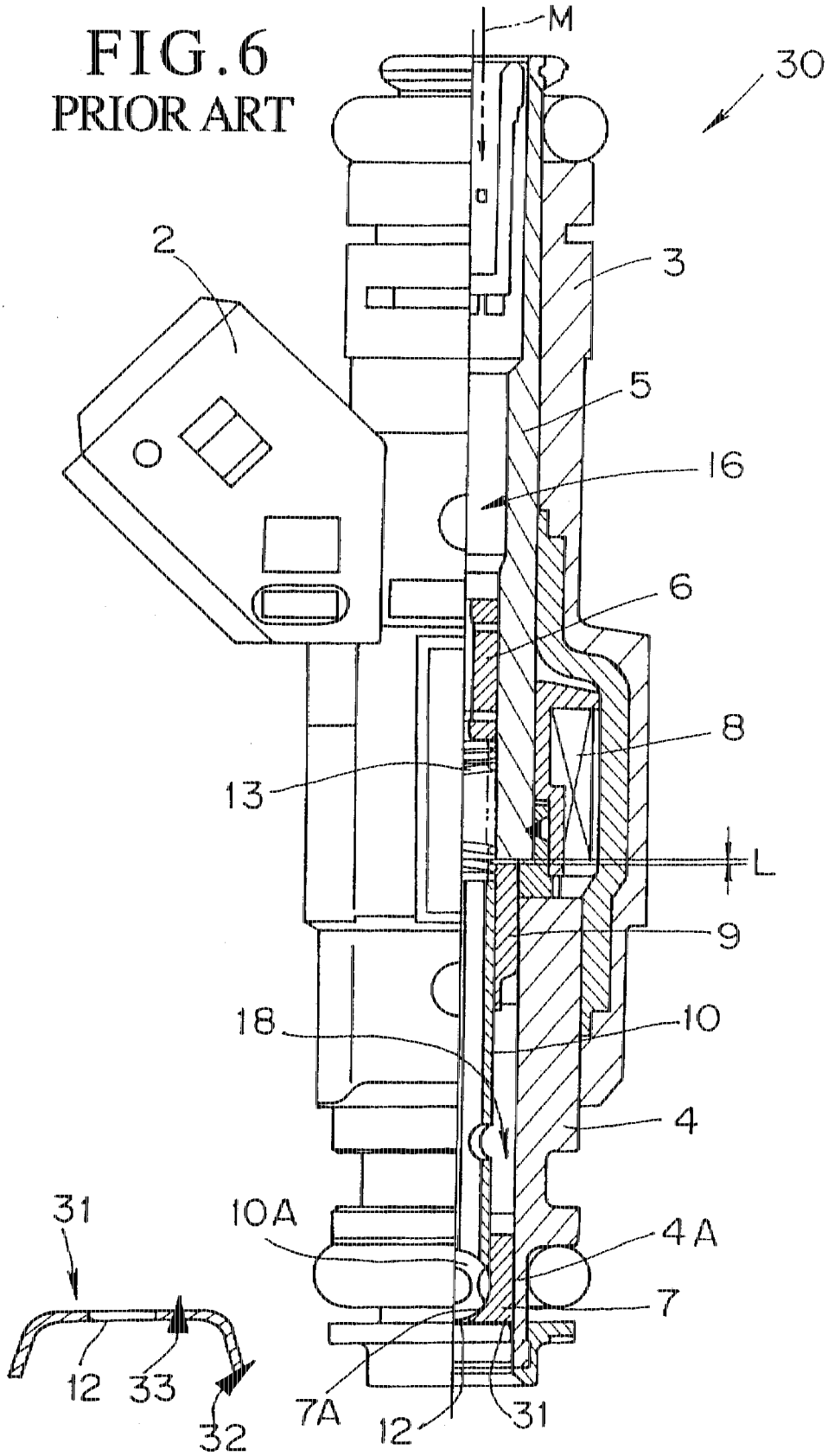
FIG. 6 PRIOR ART
FIG. 6 is a vertical cross section illustrating an example of another conventional electromagnetic fuel injection valve 30.

An electromagnetic fuel injection valve 40 in a preferred embodiment of the present invention and a method for assembling the nozzle assembly are described next with reference to FIGS. 1 through 3. Parts which are the same as those in FIGS. 5 and 6 are indicated by the same symbols, and their description is thus omitted.

Figure 1:
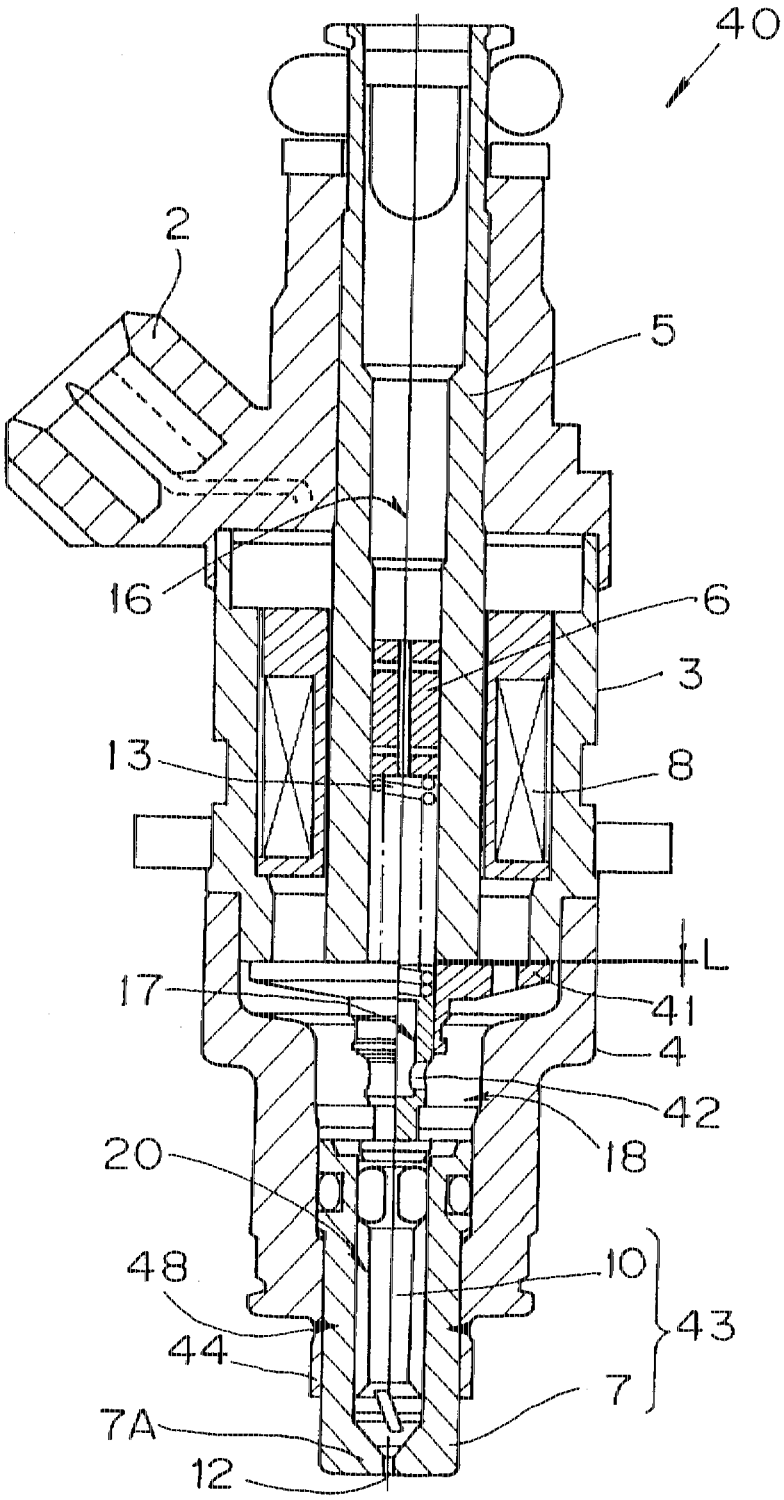
FIG. 1 is a vertical cross section of an electromagnetic fuel injection valve 40 in a preferred embodiment of the present invention.
Figure 2:
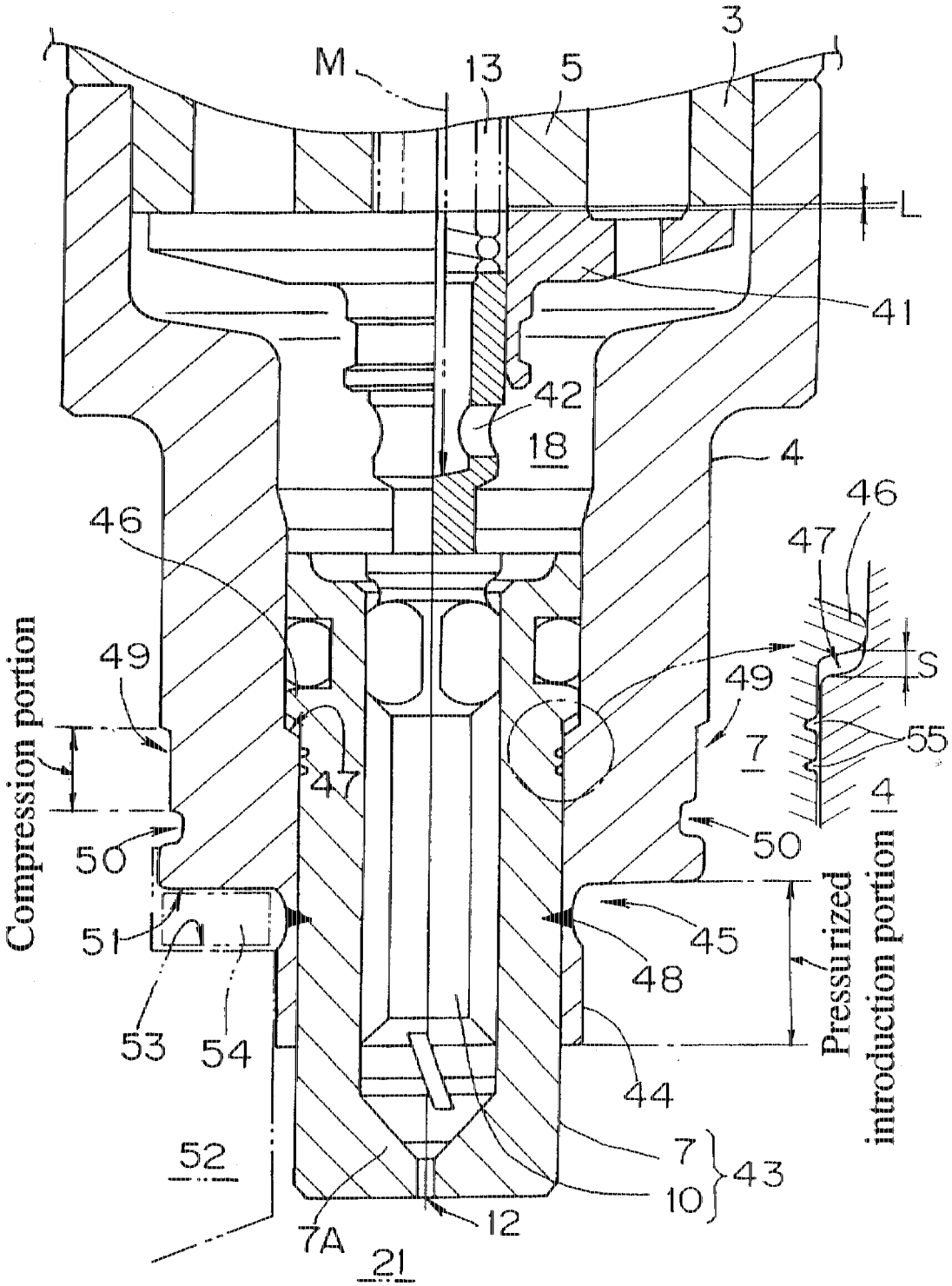
FIG. 2 is an enlarged vertical cross section of the valve seat 7 and the needle valve 10 portions in particular of this same electromagnetic fuel injection valve.
Figure 3:
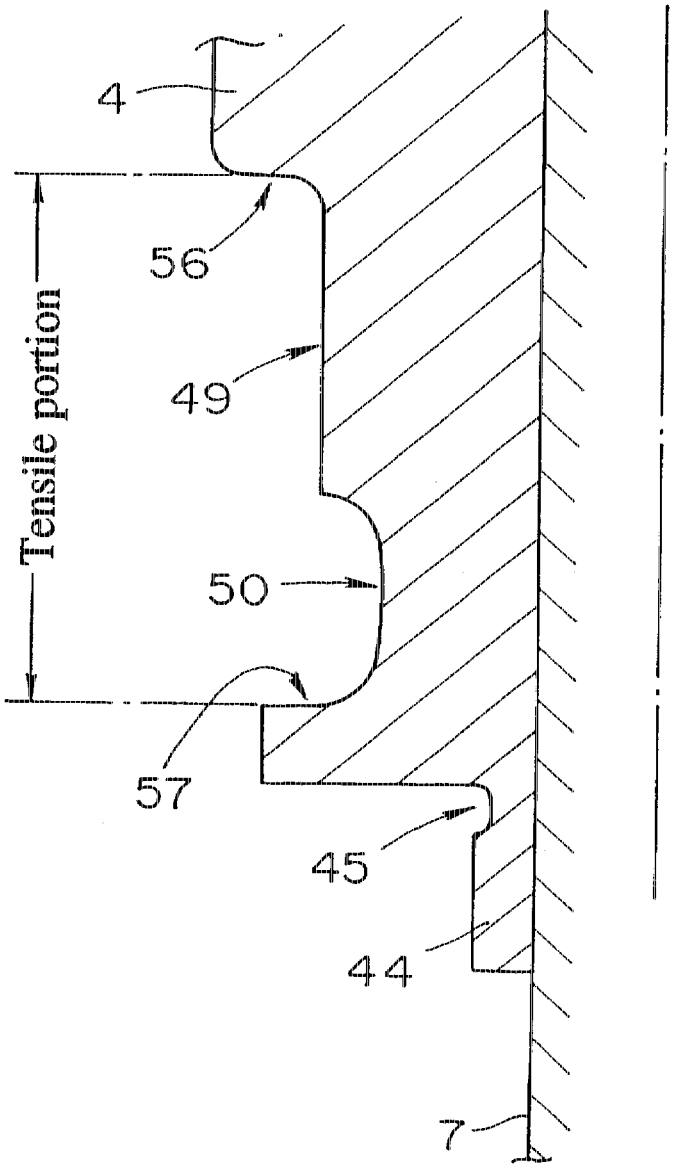
FIG. 3 is a schematic illustrating the lift amount adjusting step when tensile external force is allowed to act on the upstream side step portion 56 and the downstream side step portion 57.

FIG. 1 is a vertical cross section of an electromagnetic fuel injection valve 40, and FIG. 2 is an enlarged vertical cross section view in particular of the parts of the valve seat 7 and the needle valve 10 of the electromagnetic fuel injection valve 40. The electromagnetic fuel injection valve 40 has a flat plate-shaped armature 41 corresponding to the armature 9 described above, and the needle valve 10 can be moved integrally with the armature 41.

A communication hole 42 connecting the second fuel channel 17 and the third fuel channel 18 is formed in the needle valve 10.

A method for assembling the needle valve 10 and the valve seat 7 in the form of a nozzle assembly 43 in the nozzle holder 4 is described below along with the structure.

As shown in the enlargement in FIG. 2 in particular, a thin-walled skirt portion 44 is formed in a protruding manner from the valve seat 7 at the tip of the nozzle holder 4.

The skirt portion 44 has sufficient axial resistance against the fuel pressure and the combustion pressure from the engine cylinder 21, and it is formed with walls thin enough to allow for electronic seal welding such as laser welding, while it is long enough to fix the valve seat 7.

A welding groove 45 is formed around an outer periphery at a prescribed location in the skirt portion 44.

The nozzle assembly 43 is inserted into the skirt portion 44 while the needle valve 10 is inserted in the valve seat 7, so as to introduce the valve seat 7 under pressure (pressurized introduction step).

A protruding step portion 46 is formed along the upper outer peripheral surface of the valve seat 7, a stopper portion 47 that can be formed with the protruding step portion 46 is formed along the inner circumferential surface of the nozzle holder 4, and an adjusting stroke S portion of a prescribed length is left in the stopper portion 47 to allow an amount of lift L slightly greater (60 μ, for example) than the prescribed amount of lift L (50 μm, for example) to be maintained in the pressurized introduction step described above, In this state, laser welding is effected in the welding groove 45 to form laser welded parts 48, and the nozzle holder 4 and the valve seat 7 are integrated at the skirt portion 44 (welding step).

Since, however, the amount of lift L shrinks because of the contraction of the skirt portion 44 and the valve seat 7 due to welding holes following heat radiation during the welding operations, an excess amount of lift L is set during the pressurized introduction step, as described above, by estimating the welding deformation.

The welding deformation is thus estimated, and the pressurized introduction step and welding step are carried out, allowing the prescribed amount of lift L to be obtained.

In general, however, because of the possibility of the contraction of the skirt portion 44 and valve seat 7 resulting in an amount of lift L that is shorter than prescribed (20 to 40μm, for example, with respect to the prescribed 50 μm amount of lift), the following step for adjusting the amount of lift based on compression operations should be carried out.

That is, a compression load is applied to an outer peripheral compression portion 49 on the upstream side from the skirt portion 44 of the nozzle holder 4, with the aforementioned probe M attached to the top of the needle valve 10 to measure the amount of lift L (compression step or lift amount adjusting step).

Specifically, these compression operations can be selected from operations in which a number of prescribed locations in the outer peripheral compression portion 49 are pressed, operations in which pressure is applied in the circumferential direction around the outer peripheral compression portion 49, and the like.

Because the nozzle holder 4 can be made of SUS 304 and the valve seat 7 can be made of SUS 440 or the like, they can be irreversibly deformed by such compression operations.

These compression operations allow the amount of lift L to be increased since the nozzle holder 4 is axially extended and thus irreversibly deformed, so that the amount of lift L can be adjusted and set to the prescribed value, and the final amount of lift L can be established with good precision after the valve seat 7 has been fixed to the nozzle holder 4.

A swell-absorbing outer peripheral groove 50 can be formed on the downstream side of the outer peripheral compression portion 49 to prevent swelling from being produced by the compression operations in the seal surface 51 of the nozzle holder 4.

In other words, a seal ring 54 can be provided between the seal surface 53 of the engine cylinder block 52 and the seal surface 51 of the nozzle holder 4 to seal off combustion gas from the engine cylinder 21. Since a defective seal resulting from irregularities caused by swelling on the seal surface 51 can be avoided, leakage of combustion gas from the engine cylinder 21 can be reliably prevented.

As shown in the partial enlargement in FIG. 2, moreover, a prescribed number of expansion-preventing grooves 55 were formed in the plane of contact between the nozzle holder 4 and the valve seat 7, so that with these compression operations, part of the nozzle holder 4 can penetrate into the expansion-preventing grooves 55, and the deformation portions in the nozzle holder 4 from the compression operations can be absorbed with the outer peripheral groove 50.

In the unlikely event that the laser welded parts 48 in the welding groove 45 are broken, the protruding step portion 46 and the stopper portion 47 can be engaged. Thus, even when the laser welded parts 48 are broken by high pressure fuel in the third fuel channel 18 through the fifth fuel channel 20, or for some other reason, resulting in the detachment of the nozzle assembly 43, the valve seat 7 is engaged and stopped by the stopper portion 47, and accidents in which the nozzle assembly 43 flies off into the engine cylinder 21 can be prevented.

As an alternative to the compression step in which the outer peripheral compression member 49 is compressed in the present invention, a tensile external force can be allowed to act on a downstream side step portion 57 of the swell-absorbing outer peripheral groove 50 and an upstream side step portion 56 of the outer peripheral compression portion 49 to pull the nozzle holder 4 in the axial direction as a lift amount adjusting step.

Figure 4:
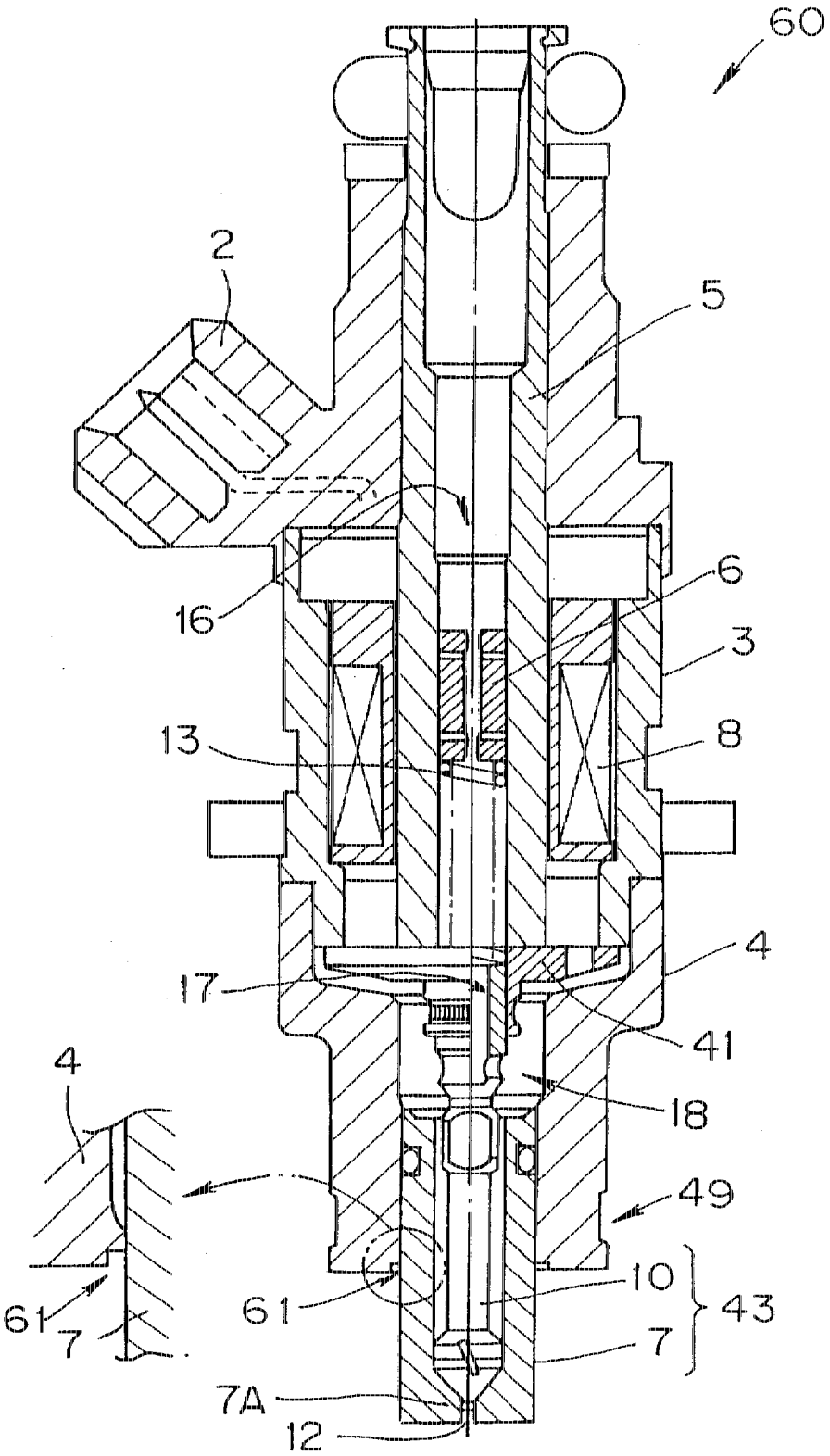
FIG. 4 is a vertical cross section illustrating an electromagnetic fuel injection valve 60 of a reference example, depicting the disadvantages when the skirt portion 44 of the present invention is not formed.

FIG. 4 is a vertical cross section illustrating an electromagnetic fuel injection valve 60 as a reference example, depicting the disadvantages of not forming the skirt portion 44 in the present invention. In this electromagnetic fuel injection valve 60, no skirt portion 44 is formed as in the electromagnetic fuel injection valve 40 shown in FIG. 1. As a result, a seal weld can be done only at the outermost tip of the nozzle holder 4.

That is, during seal welding, the nozzle holder 4 and the valve seat 7 must be brought into close contact by being introduced under pressure to the welding parts, but when they are introduced with the structure shown in FIG. 4, the valve seat 7 is inwardly deformed in the nozzle holder 4, and the needle valve 10 cannot slide.

The welding must thus be done with a loose fit between the nozzle holder 4 and the valve seat 7. As a result, welding is done only in the welding parts 61 of the outermost tip of the nozzle holder 4.

The external load on the valve seat 7 is thus applied only to the welding parts 61, resulting in the problem of extremely weak mechanical strength. Pressurized introduction operations to a thin-walled portion such as the skirt portion 44 in the nozzle holder 4 and welding operations should be implemented as shown in FIGS. 1 and 2.

As described above, the present invention involves forming a skirt portion on a nozzle holder and introducing the nozzle assembly under pressure for welding. As such, it can be adapted to fuel injection in high pressure cylinders, and the amount of lift can be adjusted and set with the prescribed precision.

Additionally, a load can be applied to the outer peripheral portion of the nozzle holder by means of compression, tension, or the like to the external compression portion of the nozzle holder, so that the nozzle holder can be extended and the precision of the amount of lift can be further enhanced.

What is claimed is:

1. An electromagnetic fuel injection valve comprising:

a valve housing;

an electromagnetic coil located in the valve housing;

an armature responding to magnetization of the electromagnetic coil;

a valve seat having a seat portion in which a fuel injection hole for fuel is formed;

a nozzle holder for fixing the valve seat; and a needle valve allowing fuel to be sprayed from the injection hole when the needle valve is lifted from the seat portion of the valve seat along with the armature in response to the magnetization of the electromagnetic coil; and a thin-walled skirt portion formed in a protruding manner at the nozzle holder, wherein the valve seat is introduced under pressure to the skirt portion, and the valve seat and nozzle holder are welded and joined at the skirt portion so as to be axially extendable substantially in unison, thereby adjusting the position of the seat portion of the valve seat and the lift of the needle valve.

2. An electromagnetic fuel injection valve as defined in claim 1, wherein the skirt portion has sufficient axial resistance against fuel combustion pressure and fuel pressure, and is formed to a length sufficient for fixing the valve seat.

3. An electromagnetic fuel injection valve as defined in claim 1, further comprising a protruding step portion along an outer peripheral surface of the valve seat and a stopper portion that can be engaged with the protruding step portion along an inner circumferential surface of the nozzle holder.

4. An electromagnetic fuel injection valve as defined in claim 3, further comprising an adjusting stroke, slightly larger than the prescribed amount of lift, provided in the axial direction of the needle valve between the protruding step portion and the stopper portion.

5. An electromagnetic fuel injection valve as defined in claim 1, further comprising a welding groove at the skirt portion.

6. An electromagnetic fuel injection valve as defined in claim 1, further comprising an outer peripheral compression portion at the nozzle holder upstream from the skirt portion.

7. An electromagnetic fuel injection valve as defined in claim 6, further comprising a swell-absorbing outer peripheral groove at the nozzle holder between the skirt portion and the outer peripheral compression portion.

8. An electromagnetic fuel injection valve as defined in claim 7, further comprising a seal member allowing combustion gas coming from an engine cylinder block to be sealed on a downstream side from the swell-absorbing outer peripheral groove.

9. An electromagnetic fuel injection valve as defined in claim 6, further comprising expansion-preventing grooves along the outer peripheral surface of the valve seat located at the outer peripheral compression portion of the nozzle holder.

10. An electromagnetic fuel injection valve as defined in claim 1, further comprising an upstream side step portion and a downstream side step portion at the nozzle holder upstream from the skirt portion.

11. An electromagnetic fuel injection valve as defined in claim 1, wherein an interval between a bottom end of a fuel supply pipe located in the valve housing and a top end of the armature, is the amount of lift of the needle valve.

12. A method for assembling a nozzle assembly of an electromagnetic fuel injection valve, wherein the valve comprises a valve housing, an electromagnetic coil located in the valve housing, an armature responding to magnetization of the electromagnetic coil, a valve seat having a seat portion in which a fuel injection hole for fuel is formed, a needle valve allowing fuel to be sprayed from the injection hole when the needle valve is lifted from a seat portion of the valve seat along with the armature in response to the magnetization of the electromagnetic coil, and a nozzle holder for fixing the valve seat by holding the needle valve and the valve seat to form the nozzle assembly, the method comprising:

introducing the valve seat under pressure to a thin-walled skirt portion formed in a protruding manner at the nozzle holder; and integrating the valve seat and the nozzle holder by welding and joining them at the skirt portion so as to be axially extendable substantially in unison, thereby adjusting the position of the seat portion of the valve seat and the lift of the needle valve.

13. The method for assembling a nozzle assembly of an electromagnetic fuel injection valve as defined in claim 12, wherein the valve seat and the nozzle holder are welded and joined on a downstream side from the armature.

14. The method for assembling a nozzle assembly of an electromagnetic fuel injection valve as defined in claim 12, further comprising adjusting an amount of lift of the needle valve by applying a lead to the outer peripheral portion of the nozzle holder while the nozzle assembly is fixed.

15. A method for assembling a nozzle assembly of an electromagnetic fuel injection valve, wherein the valve comprises a valve housing, an electromagnetic coil located in the valve housing, an armature responding to magnetization of the electromagnetic coil, a valve seat in which a fuel injection hole for fuel is formed, a needle valve allowing fuel to be sprayed from the injection hole when the needle valve is lifted from a seat portion of the valve seat along with the armature in response to the magnetization of the electromagnetic coil, and a nozzle holder for fixing the valve seat by holding the needle valve and the valve seat to form the nozzle assembly, the method comprising:

introducing the valve seat under pressure to a thin-walled skirt portion formed in a protruding manner at the nozzle holder;

integrating the valve seat and the nozzle holder by welding and joining them at the skirt portion; and adjusting an amount of lift of the needle valve by applying a lead to the outer peripheral portion of the nozzle holder while the nozzle assembly is fixed and inwardly pressing the outer peripheral compression portion of the nozzle holder.

16. A method for assembling a nozzle assembly of an electromagnetic fuel injection valve, wherein the valve comprises a valve housing, an electromagnetic coil located in the valve housing, an armature responding to magnetization of the electromagnetic coil, a valve seat in which a fuel injection hole for fuel is formed, a needle valve allowing fuel to be sprayed from the injection hole when the needle valve is lifted from a seat portion of the valve seat along with the armature in response to the magnetization of the electromagnetic coil, and a nozzle holder for fixing the valve seat by holding the needle valve and the valve seat to form the nozzle assembly, the method comprising:

introducing the valve seat under pressure to a thin-walled skirt portion formed in a protruding manner at the nozzle holder;

integrating the valve seat and the nozzle holder by welding and joining them at the skirt portion; and adjusting an amount of lift of the needle valve by applying a load to the outer peripheral portion of the nozzle holder while the nozzle assembly is fixed, and using tensile external force at the upstream side step portion and downstream side step portion of the nozzle holder so that the nozzle holder is pulled in an axial direction.

17. A method for assembling a nozzle assembly of an electromagnetic fuel injection valve, wherein the valve comprises a valve housing, an electromagnetic coil located in the valve housing, an armature responding to magnetization of the electromagnetic coil, a valve seat in which a fuel injection hole for fuel is formed, a needle valve allowing fuel to be sprayed from the injection hole when the needle valve is lifted from a seat portion of the valve seat along with the armature in response to the magnetization of the electromagnetic coil, and a nozzle holder for fixing the valve seat by holding the needle valve and the valve seat to form the nozzle assembly, the method comprising:

introducing the valve seat under pressure to a thin-walled skirt portion formed in a protruding manner at the nozzle holder;

integrating the valve seat and the nozzle holder by welding and joining them at the skirt portion;

adjusting an amount of lift of the needle valve by applying a load to the outer peripheral portion of the nozzle holder while the nozzle assembly is fixed; and inwardly pressing the nozzle holder on the downstream side from the armature.

18. A method for assembling a nozzle assembly of an electromagnetic fuel injection valve, wherein the valve comprises a valve housing, an electromagnetic coil located in the valve housing, an armature responding to magnetization of the electromagnetic coil, a valve seat in which a fuel injection hole for fuel is formed, a needle valve allowing fuel to be sprayed from the injection hole when the needle valve is lifted from a seat portion of the valve seat along with the armature in response to the magnetization of the electromagnetic coil, and a nozzle holder for fixing the valve seat by holding the needle valve and the valve seat to form the nozzle assembly, the method comprising:

introducing the valve seat under pressure to a thin-walled skirt portion formed in a protruding manner at the nozzle holder;

integrating the valve seat and the nozzle holder by welding and joining them at the skirt portion;

adjusting an amount of lift of the needle valve by applying a load to the outer peripheral portion of the nozzle holder while the nozzle assembly is fixed; and pulling the nozzle holder in the axial direction on the downstream side from the armature.

* * * * *

UNITED STATES PATENT AND TRADEMARK OFFICE

CERTIFICATE OF CORRECTION

PATENT NO. : 5,713,523

DATED : February 3, 1998

INVENTOR(S) : Takuya Fujikawa

It is certified that error appears in the above-identified patent and that said Letters Patent is hereby corrected as shown below:

The title page, showing the incorrect illustrative figure, should be deleted, and substitute therefor, the title page showing the correct illustrative figure.

Claim 14, col. 8, line 64, change "lead" to ----load----.
Claim 15, col. 9, line 17, change "lead" to ----load----.

Signed and Sealed this

Seventeenth Day of November, 1998

*Attest:*

Bruce Lehman

BRUCE LEHMAN

*Attesting Officer*

*Commissioner of Patents and Trademarks*

United States Patent [19]

Fujikawa

[11] Patent Number: 5,713,523

[45] Date of Patent: Feb. 3, 1998

[54] ELECTROMAGNETIC FUEL INJECTION VALVE, AND METHOD FOR ASSEMBLING NOZZLE ASSEMBLY

[75] Inventor: Takuya Fujikawa, Saitama, Japan

[73] Assignee: Zexel Corporation, Japan

[21] Appl. No.: 577,929

[22] Filed: Dec. 22, 1995

[30] Foreign Application Priority Data

Dec. 28, 1994 [JP] Japan ..... 6-337635

[51] Int. Cl.[6] ..... B05B 1/30

[52] U.S. Cl. ..... 239/585.1; 239/585.5; 251/129.16

[58] Field of Search ..... 239/585.1, 585.3, 239/585.4, 585.5, 533.1, 533.2, 533.3, 533.6, 533.9; 251/129.15, 129.16, 129.21; 123/305, 472; 29/890.124, 890.126, 890.129

[56] References Cited

U.S. PATENT DOCUMENTS

| | | | |
|---|---|---|---|
| 4,199,850 | 4/1980 | Velan | 29/157.1 R |
| 5,178,362 | 1/1993 | Vogt et al. | 251/129.21 |
| 5,188,336 | 2/1993 | Graner et al. | 251/129.16 |
| 5,197,672 | 3/1993 | Grytz et al. | 239/1 |
| 5,236,173 | 8/1993 | Wakeman | 251/129.16 |
| 5,244,180 | 9/1993 | Wakeman et al. | 251/129.16 |
| 5,330,153 | 7/1994 | Reiter | 251/129.21 |
| 5,383,606 | 1/1995 | Stegmaier et al. | 239/575 |
| 5,428,883 | 7/1995 | Stieglitz | 29/602.1 |
| 5,566,920 | 10/1996 | Romann et al. | 239/585.4 |
| 5,580,001 | 12/1996 | Romann et al. | 239/585.4 |

FOREIGN PATENT DOCUMENTS

| | | |
|---|---|---|
| 5-504181 | 7/1993 | Japan . |
| 5-504182 | 7/1993 | Japan . |

*Primary Examiner*—Andres Kashnikow
*Assistant Examiner*—Lisa Ann Douglas
*Attorney, Agent, or Firm*—Ostrolenk, Faber, Gerb & Soffen, LLP

[57] ABSTRACT

An electromagnetic fuel injection valve is provided, which allows the amount of lift to be adjusted and established following the assembly of the nozzle assembly so that it is suitable for high pressure cylinder injection of fuel and which also allows the amount of lift to be established with high precision. A method for assembling the nozzle assembly is also offered.

This invention comprises a thin-walled skirt portion formed in a protruding manner at the nozzle holder, a valve seat that is introduced under pressure to the skirt portion, with the valve seat and the nozzle holder welded and joined at the skirt portion, and, preferably, the application of a load from the outside of the nozzle holder following welding to bring about the irreversible deformation of the nozzle holder and establish the final amount of lift.

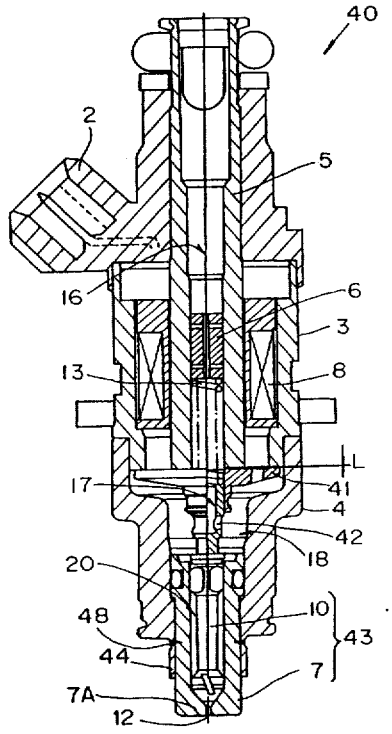

18 Claims, 6 Drawing Sheets